US007390345B2

(12) United States Patent
Solimnjad

(10) Patent No.: US 7,390,345 B2
(45) Date of Patent: Jun. 24, 2008

(54) POWDER ADDITIVE

(75) Inventor: Naghi Solimnjad, Höganäs (SE)

(73) Assignee: Höganäs AB, Hôganäs (SE)

( * ) Notice: Subject to any disclaimer, the term of this patent is extended or adjusted under 35 U.S.C. 154(b) by 59 days.

(21) Appl. No.: 11/171,194

(22) Filed: Jul. 1, 2005

(65) Prior Publication Data

US 2006/0000310 A1 Jan. 5, 2006

Related U.S. Application Data

(60) Provisional application No. 60/609,251, filed on Sep. 14, 2004.

(30) Foreign Application Priority Data

Jul. 2, 2004 (SE) ..... 0401778

(51) Int. Cl.
*B22F 1/00* (2006.01)
*B22F 3/00* (2006.01)

(52) U.S. Cl. ..... 75/252; 419/30

(58) Field of Classification Search ..... 75/252; 419/30

See application file for complete search history.

(56) References Cited

U.S. PATENT DOCUMENTS

| | | | | |
|---|---|---|---|---|
| 3,357,818 | A | 12/1967 | Findeisen et al. | |
| 3,460,940 | A | 8/1969 | Talmage | |
| 3,495,958 | A | 2/1970 | Talmage | |
| 5,443,787 | A * | 8/1995 | Mori et al. | 419/32 |
| 5,782,954 | A | 7/1998 | Luk | |
| 6,602,315 | B2 | 8/2003 | Hendrickson et al. | |

FOREIGN PATENT DOCUMENTS

| | | |
|---|---|---|
| GB | 573077 | 11/1945 |
| JP | 7-157838 A | 6/1995 |

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns a powder metallurgical composition comprising a major amount of an iron-based metal powder and a minor amount of carbon black. The amount of carbon black is between 0.001 and 0.2% by weight, preferably between 0.01 to 0.1% by weight.

15 Claims, No Drawings

POWDER ADDITIVE

The benefit is claimed under 35 § U.S.C. 119(a)-(d) of Swedish Application No. 0401778-6, filed Jul. 2, 2004, and under 35 U.S.C. § 119(e) of U.S. Provisional Application No. 60/609,251, filed Sep. 14,2004.

FIELD OF THE INVENTION

The invention relates to iron-based powder metallurgical compositions. More particularly, the present invention relates to compositions containing flow agents to improve flowability, but also to improve apparent density.

BACKGROUND OF THE INVENTION

Powder metallurgical compositions are well known for the production of powder metallurgical parts. Production of powder metallurgical parts involves filling of the powder in a compaction tool, compaction of the powder and subsequent sintering of the compacted body. A prerequisite for filling of the powder is that the powder is free-flowing and has a sufficient flow. A high flow rate of the powder is essential to obtain a high production rate giving lower production costs and a better economy for each part produced.

Another factor which is essential for the production efficiency and economy is the apparent density. Apparent density is essential for the tool design. Powder with low apparent density needs higher filling height which results in unnecessarily high pressing tools, and this in turn will result in longer compaction strokes and lower pressing performances.

Agents which improve the flow properties are previously known. Thus the U.S. Pat. No. 3,357,818 discloses that silicic acid may be used to this end. The U.S. Pat. No. 5,782,954 discloses that metal, metal oxides or silicon oxide can be used as flow agents.

It is an object of the present invention to provide a powder metallurgical composition with improved powder properties such as flowability and apparent density.

SUMMARY OF THE INVENTION

It has unexpectedly been found that by adding a small amount of carbon black, to an iron-based powder composition, the properties of the powder composition can be improved. Additionally the addition of controlled amounts of carbon black will not deteriorate the properties of green and sintered Darts prepared from the new iron-based composition but these properties may even be improved.

DETAILED DESCRIPTION OF THE INVENTION

Generally powder metallurgical compositions contain an iron or iron-based powder and a lubricant. The compositions may also include a binding agent, graphite and other alloying elements. Hard phase material, liquid phase forming material and machinability enhancing agents may also be included.

The iron-based powder may be of any type of iron-based powder such as water-atomised iron powder, reduced iron powder, pre-alloyed iron-based powder or diffusion alloyed iron-based powder. Such powders are e.g. the iron powder ASC100.29, the diffusion alloyed iron-based powder Distaloy AB containing Cu, Ni and Mo, the iron-based powder Astaloy CrM and Astaloy CrL pre-alloyed with Cr and Mo, all available from Höganäs AB, Sweden.

The amount of carbon black in the iron-based powder composition according to the invention is between 0.00 1 and 0.2% by weight, preferably between 0.01 and 0.1%. The primary particle size of the carbon black is preferably below 200 nm, more preferably below 100 nm and most preferably below 50 nm. The specific surface area of the carbon black is above 100 $m^2/g$ (e.g., above 150 $m^2/g$ or above 200 $m^2/g$) and is in a preferred embodiment between 150 and 1000 $m^2/g$ measured by the BET-method. However, other types of carbon black having other surface areas and primary particle sizes are possible to use.

Carbon black is normally used as filler in rubber material and as colour pigments. It is also used for its electrical conductivity, in products for reducing static electricity. Carbon black in combination with iron or iron-based powders is disclosed in U.S. Pat. No. 6,602,315. This patent discloses a composition wherein an alloying powder is bound to an iron-based powder by binder, to which carbon black may be added. U.S. Pat. No. 6,602,315 does not disclose any content, particle size or effect of carbon black and is only relevant to the binding material. Also in patent application JP 7-157838 a powder composition containing carbon black is disclosed. Here the purpose of carbon black is to deoxidize a base-material.

The compositions according to the present invention may also include alloying elements chosen from the group consisting of graphite, Cu, Ni, Cr, Mn, Si, V, Mo, P, W, S and Nb In order to enhance the compressibility of the powder and to facilitate ejection of the green component a lubricant or a combination of different lubricants may be added to the powder metallurgical composition. The lubricant may be present as a particulate powder or bonded to the surface of the iron-based powder. By adding a bonding agent dissolved in a solvent followed by evaporation of the solvent the lubricant may be bonded to the surface of the iron-based powder. The binder may also be added in its natural liquid state with a capacity of forming a film around the iron-based powder. Another alternative is to use the lubricants as binding agents by heating the composition above the melting point of the lubricant or above the melting point of at least one of the lubricant components followed by cooling the composition to a temperature below the melting point.

The lubricants may be selected from the group consisting of fatty acids, amide waxes such as ethylene bisstearamide (EBS), or other derivates of fatty acids such as metal stearates, polyalkylenes such as polyethylene, polyglycols, amide polymers, or amide oligomers. Preferably the lubricants are selected from the group consisting of polyalkylenes, amide waxes, amide polymers or amide oligomers.

The binders are selected from the group consisting of cellulose ester resins, high molecular weight thermoplastic phenolic resins, hydroxyalkylcellulose resins, and mixtures thereof. Preferably binders are selected from the group of cellulose ester resins and hydroxyalkylcellulose resins.

Other possible additives are machinability improving agents, hard phase material and liquid phase forming agent.

According to a preferred embodiment carbon black is used as flow agent in bonded mixtures, i.e. mixtures, wherein finer powder of e.g. alloying element particles are bonded by means of a binding agent to the surface of the iron or iron-based powder particles, as these mixtures often have poor flow properties. When used in bonded mixtures carbon black is preferably added after the binding operation has been effectuated. The binding operation may be accomplished by heating the mixture during mixing to a temperature above the melting point of the binding agent and cooling the mixture until the binder has solidified. The binder may also be added dissolved in a solvent. The binding operation is in this case accomplished by evaporating the solvent by means of heating or by vacuum. The composition is compacted and sintered to obtain the final powder metal part.

The invention is further illustrated by the following non-limiting examples:

EXAMPLE 1

Three types of carbon black were selected with various specific areas and particle sizes according to table 1. The specific surface area was determined by the BET-method. The particle size was measured by electron microscopy and refers to the primary particle size of the carbon black.

TABLE 1

| Type | Specific surface area ($m^2/g$) | Primary particle size (nm) |
|---|---|---|
| CB1* | 1000 | 30 |
| CB2* | 250 | 18 |
| CB3* | 150 | 23 |

*available from Degussa AG, Germany

Iron-base powder ASC100.29, available from Höganäs AB, Sweden, was mixed with 0.77% by weight of graphite, 0.8% of a binder/lubricant system (consisting of 0.2% of polyethylene(Polywax 650) and 0.6% of ethylene bis-stearamide (EBS)). The mixture was heated during mixing to a temperature above the melting point of Polywax and subsequently cooled. At a temperature below the melting point of Polywax, 0.03% of carbon black was added. Three different types of carbon black, according to table 1, were tested. Two mixtures were prepared as reference mixtures. Reference mixture C was prepared according to the test mixtures with the exception that 0.8% of graphite and no flow agent was added. In reference mixture R 0.8% of graphite and 0.06% of Aerosil® A-200, available from Degussa AG, was added.

Powder properties were measured. Flow property was measured using the standard method, Hall-flow cup according to ISO 4490 and the apparent density, AD, was measured using standard method ISO 3923.

The results of the powder properties are presented in table 2.

TABLE 2

| ID | Powder composition | Flow (s/50 g) | AD ($g/cm^3$) |
|---|---|---|---|
| C | ASC100.29 + 0.8% C + 0.8% lubricant | 30.0 | 3.06 |
| R | ASC100.29 + 0.8% C + 0.8% lubricant + 0.06% A-200 | 25.4 | 3.11 |
| CB1 | ASC100.29 + 0.77% C + 0.8% lubricant + 0.03 CB1 | 23.0 | 3.29 |
| CB2 | ASC100.29 + 0.77% C + 0.8% lubricant + 0.03 CB2 | 26.4 | 3.15 |
| CB3 | ASC100.29 + 0.77% C + 0.8% lubricant + 0.03 CB3 | 25.8 | 3.14 |

The tests show that the addition of carbon black to a powder metallurgical mixture improves the flow rate and AD compared to the mixture without any flow agent. Addition of CB1 improves flow and AD compared to addition of known flow agent whereas addition of CB2 and CB3 gives about the same flow improvement but a higher AD compared to addition of flow agent A-200.

EXAMPLE 2

Carbon black type CB 1 was selected in order to determine the optimal added amount to the iron-based powder mixture. The mixtures were prepared according to the description of example 1. Added amounts of alloying elements, binder/lubricant, flow agent and graphite are shown in table 3.

Reference mixtures, R1 without flow agents and R2 with a commercial available flow agent, which is Aerosil® A-200 available from Degussa AG, were prepared.

TABLE 3

| ID | Powder composition | Flow (s/50 g) | AD ($g/cm^3$) |
|---|---|---|---|
| B1 | ASC100.29 + 2% Cu + 0.8% C + 0.8% lubricant + 0.025% CB1 | 20.9 | 3.48 |
| B2 | ASC100.29 + 2% Cu + 0.8% C + 0.8% lubricant + 0.03% CB1 | 20.8 | 3.49 |
| B3 | ASC100.29 + 2% Cu + 0.8% C + 0.8% lubricant + 0.04% CB1 | 21.1 | 3.46 |
| B4 | ASC100.29 + 2% Cu + 0.8% C + 0.8% lubricant + 0.06% CB1 | 21.6 | 3.43 |
| R1 | ASC100.29 + 2% Cu + 0.8% C + 0.8% lubricant | 29.6 | 3.19 |
| R2 | ASC100.29 + 2% Cu + 0.8% C + 0.8% lubricant + 0.06% A-200 | 24.5 | 3.28 |

Test pieces according to ISO 2740 were compacted at a pressure of 600 MPa at ambient temperature and sintered at 1120° C. in an 90/10 $N_2/H_2$ atmosphere. In table 4 the mechanical properties are presented for the powder compositions according to table 3.

TABLE 4

| ID | TS (MPa) | YS (Mpa) | A (%) |
|---|---|---|---|
| B1 | 610 | 444 | 2.12 |
| B2 | 603 | 442 | 1.98 |
| B3 | 596 | 438 | 1.93 |
| B4 | 536 | 411 | 1.49 |
| R1 | 603 | 437 | 2.22 |
| R2 | 545 | 397 | 1.93 |

As can be seen from table 4 ar. added amount of 0.06% of carbon black will influence the tensile strength, TS, yield strength, YS, and elongation, A. The influence on the mechanical properties is negligible when amounts of 0.04% by weight, and lower, of carbon black were added.

EXAMPLE 3

Example 3 shows that the new flow agent can be used in compositions for warm compaction. One test mixture, B5, and one reference mixture, R3, of 3000 grams, respectively, were prepared as follows.

As a reference mixture 60 grams of a copper powder, 24 grams of graphite, 13.5 grams of a high temperature lubricant Promold® available from Morton International of Cincinnati, Ohio, USA and remaining iron powder, ASC-100.29, was thoroughly mixed during heating to 45° C. Furthermore, 4.5 grams of a cellulose ester resin dissolved in acetone was added and the mixture was mixed for 5 minutes. During a second mixing period of 10-30 minutes, while maintaining a temperature of 45° C. of the material, the solvent was evaporated. Finally, as a flow agent 1.8 grams of Aerosil® A-200 was added and thoroughly mixed.

As a test mixture 60 grams of a copper powder, 23.1 grams of graphite 13.5 grams of a high temperature lubricant Promold® available from Morton International of Cincinnati, Ohio, USA and remaining iron powder, ASC 100.29, was thoroughly mixed during heating to 45° C. Furthermore, 4.5 grams of a cellulose ester resin dissolved in acetone was added and the mixture was mixed for 5 minutes. During a second mixing period of 10-30 minutes, while maintaining a temperature of 45° C. of the material, the solvent was evaporated. Finally, as a flow agent 0.9 grams of carbon black CB1 was added and thoroughly mixed.

Flow and AD of both the mixtures were measured according to ASTM B 213 at a temperature of 120° C. In table 5 it can be seen that a substantial increase in AD was achieved for the powder mixture according to the invention, substantially the same flow rate was achieved for the composition containing the new flow agent compared to the composition containing a known flow agent.

TABLE 5

| ID | Flow (s/50 g) | AD (g/cm$^3$) |
|---|---|---|
| R3 | 21.3 | 3.25 |
| B5 | 22.0 | 3.35 |

EXAMPLE 4

Example 4 shows that the new flow agent can be used in combination with different iron-based powders. The mixtures were prepared according to the method of example 1 and the same binder/lubricant system as in example 1 was used. The iron-based powder used and amount of additives are shown in table 6. The identifications RA, RB, RC, RE and RF indicate that the mixtures are reference mixtures containing 0.06% flow agent Aerosil A-200, available from Degussa AG. The identifications C, E, and F indicate that the mixtures are reference mixtures without any flow agents. Carbon black CB1 was used in all mixtures. The iron or iron-based powder used were: ASC 100.29, an atomised plain iron powder from Höganäs AB.

Distaloy AB, a diffusion alloyed iron-based powder containing Cu, Ni and Mo from Höganäs AB.

Astaloy CrM, a pre-alloyed iron-based powder containing Cr and Mo from Höganäs AB.

Astaloy CrL, a pre-alloyed iron-based powder containing Cr and Mo from Höganäs AB.

TABLE 6

| ID | Powder mixture composition |
|---|---|
| RA | ASC 100.29 + 2% Cu powder + 0.8% graphite + 0.8% lubricant + 0.06% A-200 |
| A1 | ASC 100.29 + 2% Cu powder + 0.77% graphite + 0.8% lubricant + 0.03% CB 1 |
| RB | Dist AE + 0.8% graphite + 0.8% lubricant + 0.06% A-200 |
| B1 | Dist AE + 0.77% graphite + 0.8% lubricant + 0.03% CB 1 |
| C | ASC100.29 + 0.8% C + 0.8% lubricant |
| RC | ASC100.29 + 0.8% C + 0.8% lubricant + 0.06% A-200 |
| C1 | ASC100.29 + 0.77% C + 0.8% lubricant + 0.03% CB1 |
| E | Ast.CrM + 0.4% C + 0.8% lubricant |
| RE | Ast.CrM + 0.37% C + 0.8% lubricant + 0.06% A-200 |
| E1 | Ast.CrM + 0.37% C + 0.8% lubricant + 0.03% CB1 |
| F | Ast.CrL + 0.6% C + 0.8% lubricant |
| RF | Ast.CrL + 0.57% C + 0.8% lubricant + 0.06% A-200 |
| F1 | Ast.CrL + 0.57% C + 0.8% lubricant + 0.03 CB1 |

The powder properties of the powder mixtures were measured. Test pieces according to ISO 2740 were compacted at a pressure of 600 MPa at ambient temperature and sintered at 1120° C. 90/10 $N_2/H_2$ atmosphere. Mechanical properties such as green strength, GS, dimensional changes, DC, as well as sintered density, SD, were determined and the results are presented in table 7.

TABLE 7

| ID | Flow (s/50 g) | AD (g/cm$^3$) | GS (MPa) | DC % | SD [g/Cm$^3$] |
|---|---|---|---|---|---|
| RA | 24.8 | 3.13 | 11.3 | 0.18 | 7.01 |
| A1 | 22.6 | 3.35 | 12.8 | 0.18 | 7.04 |
| RB | 24.8 | 3.17 | 12.3 | −0.15 | 7.12 |
| B1 | 23.1 | 3.43 | 13.3 | −0.15 | 7.13 |
| C | 30 | 3.06 | | | |
| RC | 25.4 | 3.11 | 11.6 | −0.03 | 7.06 |
| C1 | 23.0 | 3.29 | 12.6 | −0.00 | 7.07 |
| E | 31.9 | 2.82 | | | |
| RE | 27.5 | 2.93 | 13.8 | −0.25 | 6.94 |
| E1 | 23.9 | 3.08 | 16 | −0.24 | 6.94 |
| F | 33.1 | 2.78 | | | |
| RF | 28.4 | 2.88 | 12.2 | −0.13 | 6.99 |
| F1 | 26.5 | 2.96 | 14.6 | −0.11 | 6.99 |

Table 7 shows that carbon black gives improved flow, AD and green strength in mixtures having different base powders compared to mixtures containing a known flow agent.

EXAMPLE 5

Example 5 shows that the new flow agent also improves flow of a plain mixture without any binding agents (not bonded mixture). Three mixtures containing the iron powder ASC100.29, 2% of a copper powder, 0.5% of graphite, 0.8% of ethylene bisstearamide as lubricant and different amounts of carbon black, CB1, according to table 8 were prepared. A mixture without any carbon black was used as reference mixture. The flow rate was measured on the different mixtures.

TABLE 8

| ID | CB1 (%) | Flow rate (s) |
|---|---|---|
| Reference | 0 | 34.2 |
| 1 | 0.06 | 31.0 |
| 2 | 0.08 | 30.3 |

As can be seen from table 8 additions of carbon black to not bonded mixtures improve the flow rate.

The invention claimed is:

1. A powder metallurgical composition comprising an iron or iron-based metal powder, a lubricant and/or a binder, and carbon black, wherein the amount of carbon black is between 0.001 and 0.2% by weight, and the carbon black has a particle size below 100 nm and a specific surface area above 100 m$^2$/g thereby increasing the flowability of the powder metallurgical composition.

2. The powder metallurgical composition according to claim 1, comprising additives selected from the group consisting of alloying elements, machinability improving agents, hard phase material and liquid phase forming agents.

3. The powder metallurgical composition according to claim 2 wherein the alloying elements are selected from the group consisting of graphite, Cu, Ni, Cr, Mn, Si, V, Mo, P, W, S and Nb.

4. The powder metallurgical composition according to claim 3, wherein the particles of at least one alloying element selected from the group consisting of graphite, and Cu are bound to the iron or iron-based powder particles.

5. The powder metallurgical composition according to claim 1, wherein the amount of carbon black is between 0.01 and 0.1% by weight.

6. The powder metallurgical composition according to claim 1, wherein the particle size of carbon black is below 50 nm.

7. A powder metallurgical composition according to claim 1, wherein the specific surface area of said carbon black is above 150 $m^2/g$.

8. A powder metallurgical composition according to claim 1, wherein the specific surface area of said carbon black is above 200 $m^2/g$.

9. The powder metallurgical composition according to claim 8, comprising additives selected from the group consisting of alloying elements, machinability improving agents, hard phase material and liquid phase forming agents.

10. A method of increasing flowability of a powder metallurgical composition comprising an iron or iron-based metal powder, a lubricant and/or a binder, the method comprising adding an amount of carbon black to said powder metallurgical composition, wherein the amount of carbon black is between 0.001 and 0.2% by weight and the carbon black has a particle size below 100 nm and a specific surface area above 100 $m^2/g$.

11. The method according to claim 10, wherein the specific surface area of said carbon black is above 150 $m^2/g$.

12. The method according to claim 10, wherein the specific surface area of said carbon black is above 200 $m^2/g$.

13. The method according to claim 10, comprising additives selected from the group consisting of alloying elements, machinability improving agents, hard phase material and liquid phase forming agents.

14. The method according to claim 11, comprising additives selected from the group consisting of alloying elements, machinability improving agents, hard phase material and liquid phase forming agents.

15. The method according to claim 12, comprising additives selected from the group consisting of alloying elements, machinability improving agents, hard phase material and liquid phase forming agents.

* * * * *